US005920942A

United States Patent [19]

Footer

[11] Patent Number: 5,920,942

[45] Date of Patent: Jul. 13, 1999

[54] COMBINATION MOP AND WIPER

[75] Inventor: Harold Footer, Newton, Mass.

[73] Assignee: Easy Day Manufacturing Company, Holliston, Mass.

[21] Appl. No.: 08/841,441

[22] Filed: Apr. 22, 1997

[51] Int. Cl.[6] ..... A47L 13/12

[52] U.S. Cl. ..... 15/121; 15/244.1

[58] Field of Search ..... 15/118, 119.1, 15/119.2, 121, 220.1, 244.1

[56] References Cited

U.S. PATENT DOCUMENTS

| | | | |
|---|---|---|---|
| 210,953 | 12/1878 | McCarthy | 15/119.2 |
| D. 327,146 | 6/1992 | Miller . | |
| 947,145 | 1/1910 | Ax . | |
| 2,534,086 | 12/1950 | Vosbikian et al. . | |
| 2,625,700 | 1/1953 | Baldwin | 15/121 |
| 2,678,458 | 5/1954 | Vosbikian et al. . | |
| 2,715,745 | 8/1955 | Jacobsen . | |
| 2,741,788 | 4/1956 | Shey . | |
| 2,842,789 | 7/1958 | Wells | 15/121 |
| 3,631,561 | 1/1972 | Aszkenas . | |
| 3,721,502 | 3/1973 | Ognibene . | |
| 3,968,535 | 7/1976 | Nichols, Jr. . | |
| 4,124,915 | 11/1978 | Schlicher . | |
| 4,312,093 | 1/1982 | Raab . | |
| 4,315,342 | 2/1982 | Ash . | |
| 4,381,575 | 5/1983 | Wendt . | |
| 4,409,700 | 10/1983 | Sullivan . | |
| 4,607,411 | 8/1986 | Lewis, Jr. . | |
| 4,785,489 | 11/1988 | Von Doehren . | |
| 4,893,370 | 1/1990 | Klotz . | |
| 4,910,825 | 3/1990 | Mauer . | |
| 5,429,678 | 7/1995 | Fany . | |
| 5,469,594 | 11/1995 | Nolte . | |
| 5,515,570 | 5/1996 | Muscroft . | |
| 5,539,949 | 7/1996 | Stanton . | |
| 5,575,032 | 11/1996 | Cernuska . | |
| 5,615,449 | 4/1997 | Sepke . | |
| 5,666,685 | 9/1997 | von Grolman | 15/121 |

FOREIGN PATENT DOCUMENTS

| | | | |
|---|---|---|---|
| 0 625 329-A1 | 11/1994 | European Pat. Off. . | |
| 2125689 | 3/1984 | United Kingdom | 15/121 |

OTHER PUBLICATIONS

Color copies of instant photographs of products which may have been publically used or on sale before the filing date of this application (7 numbered pages).

Combination Broom/Mop, Squeegee, developed by Romanos A. Raad, product literature, date unknown.

Home–Maid Flipper/Squeegee™ mop for floors, packaging label, product literature, date unknown.

Mechanical Sponge Mop Squeezing Device, M. K Project, product literature, Jan. 25, 1997.

*Primary Examiner*—Randall E. Chin

*Attorney, Agent, or Firm*—Wolf, Greenfield & Sacks, P.C.

[57] ABSTRACT

The invention features a floor mop that includes a mop handle and a mop head assembly attached to the handle. A sponge and wiper are positioned on the mop head assembly such that the handle is positioned at a first rearward-facing acute angle relative to the floor while a working surface of the sponge engages the floor. The sponge and wiper are also positioned such that the mop handle is positioned at a second rearward-facing acute angle relative to the floor while a working end of the wiper engages the floor.

2 Claims, 2 Drawing Sheets

COMBINATION MOP AND WIPER

BACKGROUND OF THE INVENTION

For centuries, people have mopped floors and left them to dry. Although it is possible to wipe a floor dry with absorbent material or a squeegee, a large number of floors are left wet every day in households, businesses, and public buildings. This practice also continues despite the fact that mops and window cleaning implements that combine a squeegee and a sponge are known. Many of these implements have a blade and sponge on different sides of the implement's handle, requiring the user to flip them over when switching from sponge to squeegee. In another design a knife removes liquid and dirt from a window and causes it to fall down on a spongy layer, which absorbs it. A reciprocating wiper attachment has also been proposed for window cleaners, car washing attachments, and hand mops.

SUMMARY OF THE INVENTION

In one general aspect, the invention features a floor mop that includes a mop handle and a mop head assembly attached to the handle. A sponge and wiper are positioned on the mop head assembly such that the handle is positioned at a first rearward-facing acute angle relative to the floor while a working surface of the sponge engages the floor. The sponge and wiper are also positioned such that the mop handle is positioned at a second rearward-facing acute angle relative to the floor while a working end of the wiper engages the floor.

In particular embodiments, a portion of the sponge contacts the floor while the wiper is used to dry the floor; the working end of the wiper and an absorbent face of the sponge, which can be its front or rear face, are separated by a small enough distance that liquid moved by the wiper reaches the absorbent face of the sponge; the sponge has an absorption capacity of at least six times its weight; a mop head attaches the wiper and handle relative to the sponge; and the wiper is positioned ahead of the sponge.

In another general aspect, the invention features a mop for mopping floors that includes a mop handle and mop head assembly means attached to a coupling end of the handle. The mop head assembly means include means for contacting and mopping the floor with a mopping liquid, means for wiping the mopping liquid from the floor, and means for absorbing the mopping liquid wiped from the floor by the means for wiping the floor. The means for contacting and mopping, the means for wiping, and the means for absorbing are positioned on the mop head assembly means such that the mop handle is positioned at a first acute angle relative to the floor while the means for contacting and mopping is used to mop the floor, and such that the mop handle is positioned at a second acute angle relative to the floor while the means for wiping is used to dry the floor.

In particular embodiments, the means for contacting and mopping and the means for absorbing are both part of a common absorbent means; and the means for contacting and mopping, the means for wiping, and the means for absorbing are positioned on the mop head assembly means such that the grip end of the handle is positioned at a first height from which it can be grasped comfortably by a standing person with his or her hands in a first position relative to the handle while the means for contacting and mopping is used to mop the floor, and such that the grip end is positioned at a second height from which it can also be grasped comfortably by the same standing person with his or her hands in the first position relative to the handle while the means for wiping is used to dry the floor.

In a further general aspect of the invention, the invention features a floor mop that includes a sponge, a floor mop handle having a coupling end attached relative to the sponge and a grip end located above and to the rear of the sponge's working surface. The floor mop also includes a wiper attached relative to the sponge and relative to the coupling end of the handle. The wiper has a working edge, and the distance separating the working edge and a bottom edge of a front surface of the sponge is less than about 30 millimeters.

In particular embodiments, the absorbent face of the sponge and the working edge of the wiper are separated by a small enough distance that liquid moved by the wiper reaches the face of the sponge; the vertical clearance between the wiping edge of the wiper and the floor is below 25 mm, measured with the working surface engaged with the floor; the distance separating the working edge of the wiper and the bottom edge of the front surface of the sponge is less than about 22 mm; and the distance separating the working edge of the wiper and the bottom edge of the front surface of the sponge is less than about 18 mm.

In another general aspect, the invention features a mop for mopping floors that includes a mop handle and mop head assembly means attached to a coupling end of the handle. The mop head assembly means include means for contacting and mopping the floor with a mopping liquid, means for wiping the mopping liquid from the floor, and means for absorbing the mopping liquid wiped from the floor by the means for wiping the floor. The means for contacting and mopping, the means for wiping, and the means for absorbing are positioned on the mop head assembly means such that liquid moved by the wiper during wiping reaches the absorbent face of the sponge.

In a further general aspect of the invention, the invention features a method of mopping a floor. The method includes providing a floor mop that includes a wiper, mopping the floor from a standing position with the first working surface while holding the floor mop at a first angle, tilting the mop's handle from the first angle to a second angle to cause a working end of the wiper to contact the floor, wiping liquid from the floor with the wiper, and absorbing liquid wiped in the step of wiping with an absorbent surface of the mop during the step of wiping. In particular embodiments, the step of mopping and the step of absorbing employ a same sponge.

Mopping floors with mops according to the invention can improve the process of cleaning floors and ensure that no film is left on them. Because much of the soiled mopping liquid that would likely have been left on the floor can be removed instead of being allowed to dry on the floor, a floor can be made cleaner. Alternatively, the invention may allow a user to maintain a desired level of cleanliness with less frequent mopping, resulting in reduced labor costs.

Mopping with mops according to the invention can also make an area safer. Because a floor need never be left wet and unattended, accidents due to slipping are less likely to occur. And because people will tend to walk through drying areas less frequently, dirt on their shoes will not be added to the newly mopped area, reducing another source of dirt on floors.

In addition, mopping floors with mops according to the invention can reduce the expense of roping off parts of a building and may result in floors being usable sooner. Because much or even substantially all of the mopping liquid can be removed during mopping, a dry floor can become available immediately after mopping, instead of being roped off while it dries in commercial applications, or instead of waiting for the floor to dry in domestic applications. Companies may also be able to dispense with buying, transporting and storing "wet floor" signs and avoid labor costs associated with deploying them and returning to get them after floors have dried.

These advantages are possible without great expense and without a significant burden on the person mopping. Implementations of the invention can be made which are only marginally heavier than standard mops, and which cost little more. And with careful ergonomic design and technique, switching from mopping to drying can be quick and easy compared to prior art combined mops, making the overall mopping task less cumbersome.

DETAILED DESCRIPTION

Figure 1:
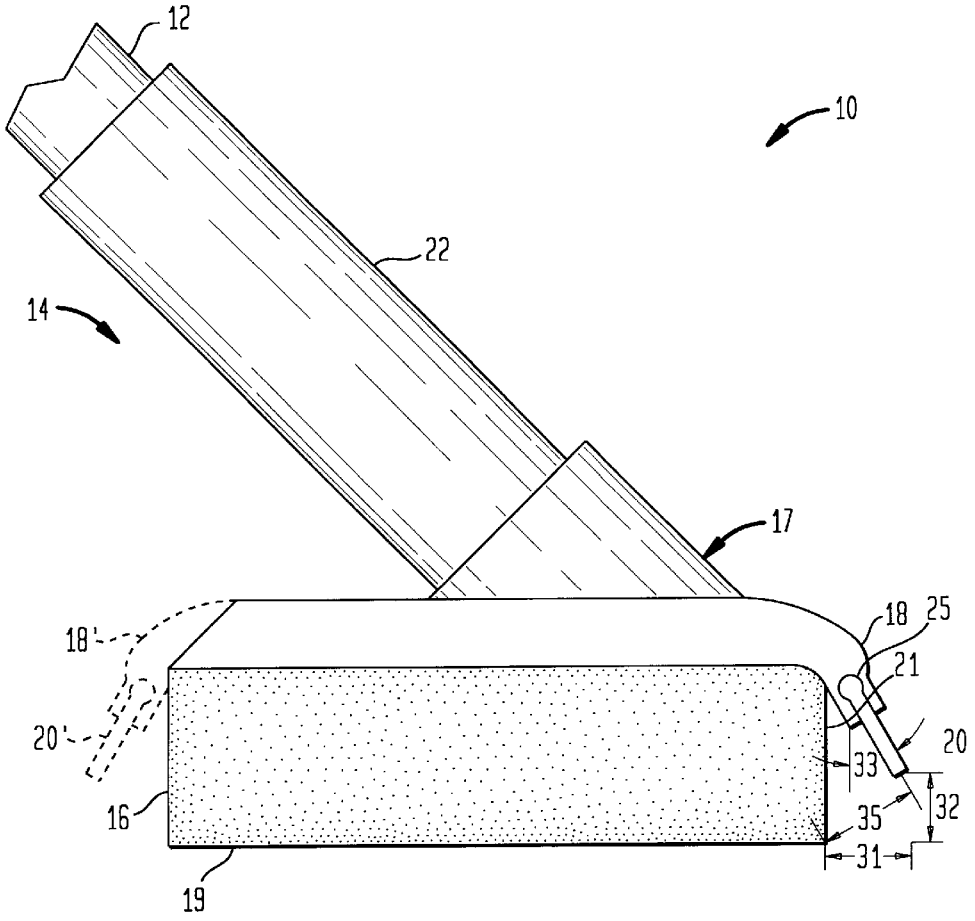
FIG. 1 is a side view of an illustrative mop according to the invention in its mopping position with part of its mop handle cut away and showing an alternative wiper placement.
Figure 2:
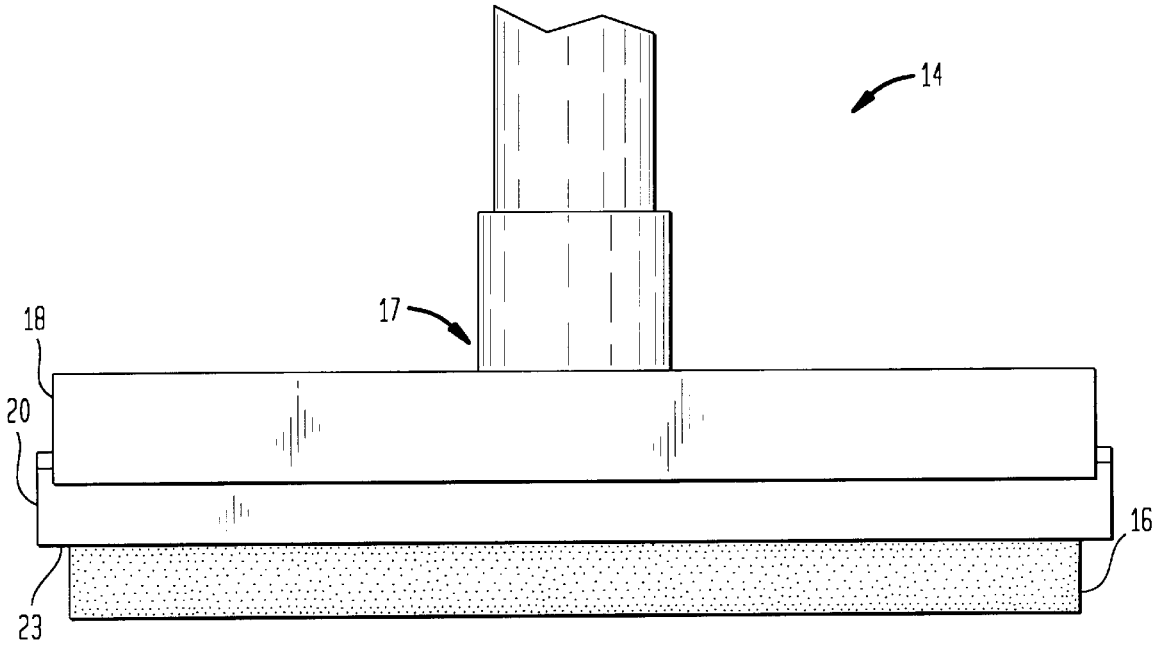
FIG. 2 is a front view of the mop head assembly of the mop of FIG. 1.

Referring to FIGS. 1 and 2, a mop 10 according to an illustrative embodiment of the invention includes a mop handle 12 coupled to a mop head assembly 14. The mop head assembly includes a mop head 17 on which a sponge 16 is mounted. The mop head includes a wiper mount 18, which can hold a wiper 20, such as a resilient squeegee blade. The mop head also includes a coupling 22 to hold the mop handle 12 by its coupling end 13, which is opposite its grip end 15 (see FIG. 3). The mop head can be made of metal, plastic, or any other suitable material that can hold the sponge and wiper in a rigid relationship, although multi-part mop head assemblies that can be disassembled or adjusted are also possible. Note that the interrelationship between the sponge, handle, and squeegee can also be maintained without being directly connected to the mop head (e.g., the wiper could be connected to the handle via an additional part). It is conventional to think of the sponge as being on the bottom of the mop, and the grip end as being at the back of the mop.

Generally, the coupling 22 holds the mop handle 12 at an angle with respect to a working surface 19 of the sponge 16. The wiper mount 18 in the mop head 17 holds the wiper 20 in a position somewhat in front of a front face 21 of the sponge. In one embodiment, a ridge on a top edge 25 of a wiper blade is held in a channel in the wiper mount, but other methods of attaching the wiper can also be used, such as coinjection.

The mop head 17 holds the wiper 20 at an inclination angle 33 from the vertical with its working edge 23 below its top edge 25. The working edge is located at a height 32 above the working surface 19 of the sponge and at a distance 31 in front of the front surface 21 of the sponge (measured with the sponge uncompressed and flat on the floor). Dimension numbers for one illustrative embodiment are listed in Table 1.

TABLE 1

| Dimension | Value |
|---|---|
| Height 32 of Working Edge from Floor | 22 mm |
| Distance 31 from Front Sponge Face to Working Edge | 14 mm |
| Inclination Angle 33 | 26° |

The clearance or height of the working edge from the floor 32 should be at least about 17 mm, preferably around 22 mm, or even 25 mm. The distance 35 from the bottom edge of the front sponge face to the working edge should be below 30 mm, preferably less than 22 mm, or even below 18 mm.

Figure 3:
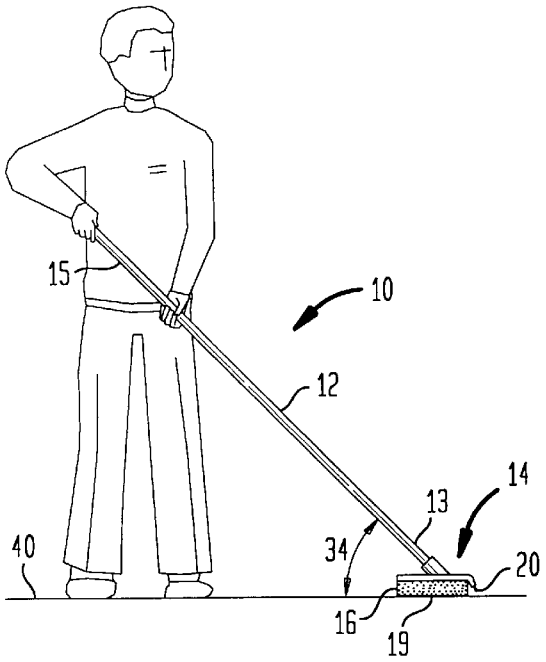
FIG. 3 is a sketch illustrating the use of the mop of FIG. 1 in mopping position.

In operation, referring to FIG. 3, the user of the mop 10 begins by mopping the floor 40 in the usual manner. The wiper 20 generally does not touch the floor during mopping because its working edge 23 is positioned somewhat above the working surface 19 of the sponge 16. This will prevent the wiper from interfering with the mopping operation.

Figure 4:
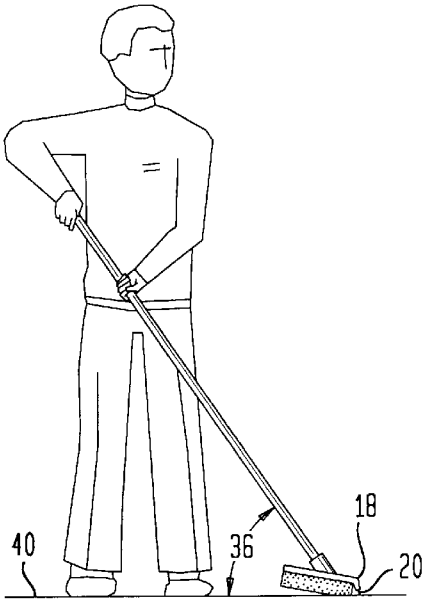
FIG. 4 is a sketch illustrating the use of the mop of FIG. 1 in drying position.

Referring to FIG. 4, once the user has finished mopping the floor 40 or a portion thereof, he or she can wipe the floor or that portion with the working edge 23 of the wiper 20. The user first tilts the mop handle 10 upward until the working edge contacts the floor, and then draws the wiper towards him- or herself to wipe the mopping liquid off of the floor. During this operation, the user will hold the mop with a larger, but still acute, average angle 36 between the mop and the floor, compared with the angle he or she used during mopping (angle 34 in FIG. 3).

Figure 5:
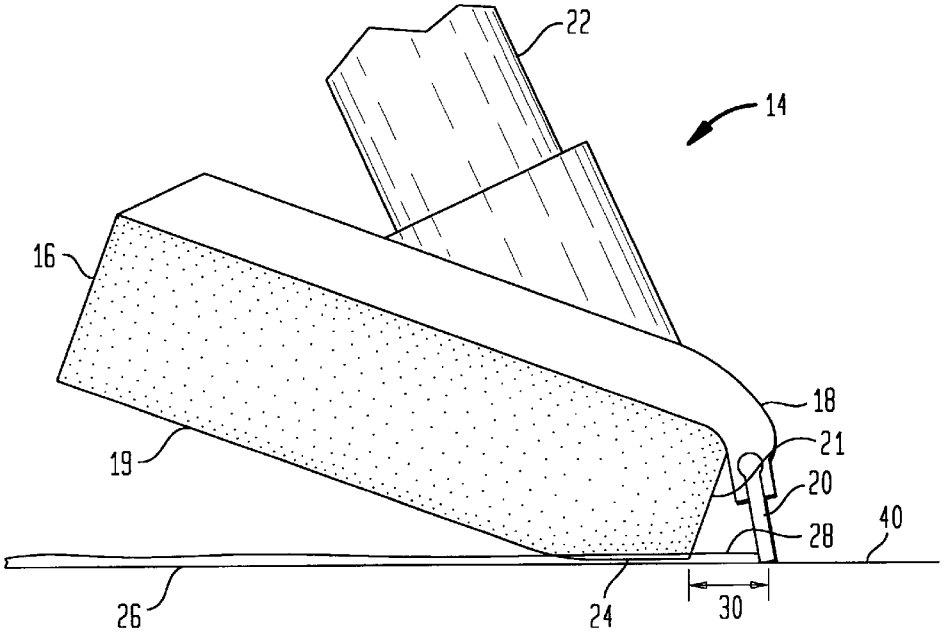
FIG. 5 is a side view of the mop head assembly of FIG. 1 in drying position.

Referring to FIG. 5, a portion 24 of the sponge 16 at the front of the working surface 19 is slightly compressed during drying. As the user draws the sponge along, that portion of the sponge will be pulled over the mopping liquid 26, and may absorb some of it. Substantially all of the remaining mopping liquid 28 will be wiped by the wiper 20 and will form a small pool in the gap 30 that separates the wiper from the front surface 21 of the sponge. The sponge will wick the water in this pool into the sponge as the user pulls the mop, and thereby leave the floor relatively dry at the end of the stroke.

Because the front surface of the sponge wicks away the mopping liquid 28, the use of the mop 10 represents an advantage over separate use of a mop and a squeegee. If a squeegee were used after mopping, it would typically accumulate large pools of water at the end of its stroke and this water would have to be removed from the floor. By mopping as described above, however, the water can simply be wrung out of the sponge. In particular trials, embodiments of the invention have left a smooth synthetic floor surface with only a negligible trace of water after a single stroke of the wiping edge, instead of leaving pools of water. Other types of flooring material or other factors may result in much, but not all, of the water being removed from the floor, but this may still represent a significant improvement over prior art methods. It is also contemplated that somewhat different wiper materials and positions may be used to achieve good results in different conditions.

It is important to keep the working edge 23 of the blade 20 relatively close to the line along which the front surface 21 of the sponge 16 touches the floor 40 (i.e., to keep the gap 30 small). This keeps the mopping liquid in a pool that contacts with the absorbent face of the sponge during drying strokes, and helps to achieve the wicking action. It is generally also important that the blade be in contact with the floor at all times when the mop is in its drying position.

As can be seen from FIGS. 3 and 4, the mop head 17 is designed to position the wiper 20 and the sponge 16 with respect to the handle 12 in such a way that both mopping and drying can be performed while standing with one's arms in a similar comfortable position. To switch from mopping to drying the user need only shift his or her position while keeping his or her hands in the same position relative to the mop handle. He or she need not let go of the mop, turn it over, or grip it in a different way. To this end, the angle between the floor and mop handle 12 in mopping position 34 and the angle between the floor and the mop handle in drying position 36 can be designed to result in the most comfortable operation for the average intended user.

Determining what the actual desired angles should be for the illustrative positions in FIGS. 3 and 4 can be accomplished using well known ergonomic methods, or can be determined empirically based on the preferences of users. It is also possible to design a mop where the angle between the mop and handle and mop head is adjustable, allowing each user to configure the mop according to his or her height, arm length, and individual preferences. It is also possible to include a mechanism to achieve the desired mop head positioning. In one embodiment, the mopping angle 34 is 47° and the drying angle 36 should be less than 90° (i.e., both angles should be acute). Note that there is a trade-off between the working edge clearance 32 and the difference between the mopping position angle 34 and the drying position angle 36. The distance from the front sponge face to the working edge also impacts the difference in the angles, as do other variables. It is therefore desirable to keep the difference in mop handle angles to within user comfort levels while also providing enough clearance for the wiper and an appropriate sponge-face-to-working-edge distance 31. The dimensions should also ensure that the pooling action occurs and allows the drying of the floor.

The sponge should be absorbent enough to absorb the liquid that reaches the absorbent face of the sponge during the drying stroke. Sponges that contain cellulose are well suited, and other materials, such as PVA, can also provide acceptable or even greater performance. To this end, it is contemplated that a sponge with an absorption capacity of at least six times its weight should be used. Sponge absorbtivity is measured by immersing a clean dry sponge in water for 30 seconds, allowing it to drip for 30 seconds, and then weighing the wet sponge.

Referring again to FIG. 1, an alternative wiper mount 18' can be provided on the back of the mop head 17. Using this embodiment, the user mops the floor at one angle, and then tilts the mop downward to engage the wiper 20' with the floor. He or she then pushes the mop to wipe the floor. As noted above, it is also possible to use different structures to achieve a desired relative attachment between the sponge, wiper, and handle, instead of attaching them all to a mop head. For example, the wiper could be attached to a wiper mount mounted on the handle but not forming a part of the mop head. Different types of wipers can also be used, such as multi-blade squeegees.

The invention can be applied to a wide variety of mops. For example, a mop employing principles according to the invention can employ a butterfly or other mechanism to allow the user to wring out the sponge. Certain of the novel and unobvious features of the invention could also be applied to other cleaning implements such as hand mops. It is further contemplated that a wiper attachment could be provided for retrofitting to pre-existing mops to obtain a floor mop in accordance with the invention.

The present invention has now been described in connection with a number of specific embodiments thereof. However, numerous modifications which are contemplated as falling within the scope of the present invention should now be apparent to those skilled in the art. Therefore, it is intended that the scope of the present invention be limited only by the scope of the claims appended hereto.

What is claimed is:

1. A floor mop, comprising:

a sponge having a flat working bottom surface and having a flat absorbent forward face, the absorbent face having a bottom edge, a floor mop handle having a coupling end attached relative to the sponge and a grip end located above and to the rear of the working surface, and a wiper attached relative to the sponge and relative to the coupling end of the handle and extending downwardly from an upper portion of the sponge towards the working surface of the sponge at an angle of approximately 26° relative to a line perpendicular to the working surface such that when the flat working bottom surface is placed flat on the floor, the handle is oriented at an angle with respect to the floor, the wiper having a working edge;

wherein the distance separating the working edge of the wiper and the bottom edge of the absorbent face of the sponge is less than about 22 mm.

2. A floor mop, comprising:

a sponge having a flat working bottom surface and having a flat absorbent forward face, the absorbent face having a bottom edge, a floor mop handle having a coupling end attached relative to the sponge and a grip end located above and to the rear of the working surface, and a wiper attached relative to the sponge and relative to the coupling end of the handle and extending downwardly from an upper portion of the sponge towards the working surface of the sponge at an angle of approximately 26° relative to a line perpendicular to the working surface such that when the flat working bottom surface is placed flat on the floor, the handle is oriented at an angle with respect to the floor, the wiper having a working edge;

wherein the distance separating the working edge of the wiper and the bottom edge of the absorbent face of the sponge is less than about 18 mm.

* * * * *